US007325593B2

(12) United States Patent
Kujirai

(10) Patent No.: US 7,325,593 B2
(45) Date of Patent: Feb. 5, 2008

(54) RADIATING FIN AND RADIATING METHOD USING THE RADIATING FIN

(75) Inventor: Masami Kujirai, Kawaguchi (JP)

(73) Assignee: Suikoh Top Line Co., Ltd., Tokyo (JP)

( * ) Notice: Subject to any disclaimer, the term of this patent is extended or adjusted under 35 U.S.C. 154(b) by 629 days.

(21) Appl. No.: 10/471,932

(22) PCT Filed: Mar. 19, 2002

(86) PCT No.: PCT/JP02/02601

§ 371 (c)(1),
(2), (4) Date: Sep. 17, 2003

(87) PCT Pub. No.: WO02/076163

PCT Pub. Date: Sep. 26, 2002

(65) Prior Publication Data

US 2004/0104021 A1 Jun. 3, 2004

(30) Foreign Application Priority Data

Mar. 21, 2001 (JP) ..... 2001-81572

(51) Int. Cl.
*F28F 13/18* (2006.01)
*F28F 7/00* (2006.01)

(52) U.S. Cl. ..... 165/133; 165/185; 29/890.046

(58) Field of Classification Search ..... 165/133, 165/80.3, 182, 184, 185; 29/890.046, 890.048, 29/890.049

See application file for complete search history.

(56) References Cited

U.S. PATENT DOCUMENTS 1,578,254 A * 3/1926 Bennett ..... 205/180
4,093,755 A * 6/1978 Dahl et al. ..... 427/451
4,723,597 A * 2/1988 Sonoda ..... 165/133
5,014,774 A * 5/1991 Siak et al. ..... 165/133
5,042,574 A * 8/1991 Cottone et al. ..... 165/133
5,289,872 A * 3/1994 Kent ..... 165/133
5,366,004 A * 11/1994 Garner et al. ..... 165/133
5,720,340 A * 2/1998 Ohara et al. ..... 165/133
5,732,767 A * 3/1998 Saperstein ..... 165/133
5,800,673 A * 9/1998 Okuda et al. ..... 159/28.6
6,439,301 B1 * 8/2002 Maytal ..... 165/184
6,595,271 B2 * 7/2003 Komoda ..... 165/133
6,604,572 B2 * 8/2003 Kawamoto ..... 165/133

FOREIGN PATENT DOCUMENTS

JP 2-85694 * 3/1990 ..... 165/166
JP 2-188949 7/1990
JP 6-3086 1/1994
JP 9-181470 7/1997
JP 10-118731 5/1998
JP 10-281690 * 10/1998 ..... 165/166

* cited by examiner

*Primary Examiner*—Tho Duong
(74) *Attorney, Agent, or Firm*—Wenderoth, Lind & Ponack, L.L.P.

(57) ABSTRACT

It is an object of the present invention to provide an inexpensive heat radiating fin having a high cooling effect. A coating metal layer consisting of a metallic material with an ionization tendency larger than that of silver is coated on a surface of a heat radiating fin main body by plating or the like to form the heat radiating fin. Thus, the coating metal layer has a layer thickness which increases a difference between a heat capacity of the coating metal layer and a heat capacity of the air, and facilitates chemical adsorption of molecules in the air. The heat radiating fin radiates heat while being brought into contact with the air serving as a cooling fluid.

15 Claims, 5 Drawing Sheets

RADIATING FIN AND RADIATING METHOD USING THE RADIATING FIN

TECHNICAL FIELD

The present invention relates to a heat radiating fin for a heating element of an electric product, an electronic apparatus, and the like. In particular, the invention relates to a heat radiating fin with a remarkably improved heat radiating effect and a heat radiating method using the same.

BACKGROUND ART

Various kinds of heat sinks (heat radiating fins) are used as heat radiating means in an electric product or an electronic apparatus such as a television, a computer, or a motor, an engine and a radiator of an automobile, various types of machinery, and the like for preventing malfunction or degradation of functions following heat radiation. As a constituent material of a heat radiating fin, a metallic material such as aluminum or copper having a high heat conductance is generally used.

As a method of improving a heat radiating effect of such a heat sink, various methods have been proposed up to now. For example, as a method of increasing a heat radiating area thereof, alumite work or blast work, and a method of increasing the number of fins (JP 11-238837 A), a method of curving an envelope of a heat radiating fin to increase velocity and flow rate of cooling wind passing through the heat radiating fin (JP 10-242357 A), a method of decreasing a heat capacity of a heat radiating fin (JP 10-116942 A), and the like have been adopted.

Moreover, in order to further improve the heat radiating effect, an air cooling system for cooling the air through ventilation with a combination of a heat radiating fin and a fan, a water cooling system using cooling water, and a cooling method using a Peltier element on a heat radiating fin side (JP 10-318624 A), and the like have been proposed.

All of the above-mentioned conventional cooling methods have various problems. For example, in the method of increasing the number of fins to increase a surface area of a heat radiating fin, if the number of fins is increased excessively, a flow of air is clogged, causing degradation in the heat radiating property. In addition, in the method of decreasing a heat capacity of a heat radiating fin, if the thickness of the fins is reduced excessively in order to reduce the heat capacity, mechanical strength decreases and the heat radiating fin is liable to be broken.

The alumite work or the blast work has a problem in that very small holes are clogged due to secular change, causing lowering of the heat radiating effect.

Although the above-mentioned air cooling system is simple in structure, since a heat conductance between the air and the fins is small, it is necessary to increase the heat radiating area or increase a flow rate of air using a fan. Thus, problems such as an increase in the size of an apparatus and noise following ventilation occur.

On the other hand, the water cooling system has a significant cooling effect because a specific heat of water is large and a heat conductance is high. However, the water cooling system requires a circulation system and a pump for circulating water and a radiator and a fan for radiating heat to the open air, and a structure thereof becomes complicated and an apparatus is enlarged. Accordingly, the cost and power consumption of the apparatus increases, which is economically disadvantageous.

Since the cooling method using a Peltier element requires a Peltier element, a heat radiating fin, and a fan, and power consumption of the Peltier element is large, the method is economically disadvantageous.

SUMMARY OF THE INVENTION

It is an object of the present invention to eliminate the above-mentioned disadvantages in the prior art, and to provide an inexpensive heat radiating fin having a high cooling effect.

As a result of concentrating efforts in examination, the inventors completed the present invention based upon the knowledge described below.

That is, due to the fact that heat conductance between the air and metal is small compared with heat conductance between water and metal, the fact that heat capacity of the air is small compared with heat capacity of water can be pointed out. Moreover, molecules in the air adhere to a metal surface of a heat radiating fin due to physical adsorption without exchange of electrons or chemical adsorption with exchange of electrons and coat the metal surface, and these adsorption layers form a heat insulating layer to prevent heat radiation.

The chemical adsorption is caused by bonding such as covalent bonding, electrostatic attraction, or ion exchange action, and adsorbs the molecules selectively in a specific adsorption site to form a unimolecular adsorption layer excluding formation of an oxide layer or the like.

In addition, since the physical adsorption is caused by condensation of molecules or a force similar to the condensation due to a Van der Waals force, an electrostatic interaction, or the like, molecules adhere uniformly to an entire interface rather than a specific site of the surface. Further, one characteristic of the physical adsorption is that it is polymolecular layer adsorption.

A force attracting molecules of a polymolecular adsorption layer to a surface (dispersion force) is the largest in a first layer and decreases step by step in a second and subsequent layers. For example, in the case in which the molecules are adsorbed on a metal, although an adsorption force between the first layer and the metal is large, when the relatively large number of layers deposit on the first layer, the same gas coheres on a gas to be adsorbed. An adsorption force at this point is relatively small compared with the adsorption force between the first layer and the metal.

Therefore, when molecules in the air with a small heat conductance are adsorbed to the metal, formation of a multilayer with same the molecules is advanced thereon. Further, it is considered that this multilayer of molecules becomes an insulating layer as it becomes thick, and prevents heat radiation from the metal. Thus, it is considered that, if the layer of molecules of gas physically adsorbed to the surface of the metal is desorbed and removed, the heat radiation effect can be improved.

Here, in general, in the chemical adsorption, it takes time to cross a peak of activation energy for adsorption, and an adsorption velocity is low. On the other hand, in the physical adsorption which does not require activation energy for adsorption, an adsorption velocity thereof is high. Therefore, molecules are first physically adsorbed to the surface of the metal. Then, when energy sufficient for crossing the peak of the activation energy is obtained, the chemical adsorption is caused to discharge a large amount of energy. Heat radiation due to the chemical adsorption to the surface of the metal is 10 to 100 kcal/mol. In addition, heat radiation of the physical adsorption is several kcal/mol or less, which is smaller than that of the chemical adsorption. On the other hand, the adsorbed molecules are desorbed from the surface to return to the space when the molecules are given the same energy as at the time of adsorption while being retained on the surface.

Incidentally, nitrogen existing in a large volume in the air has a small amount of chemical activity and is physically adsorbed to metal in many cases. On the other hand, oxygen having a large amount of chemical activity is subjected, in many cases, to the chemical adsorption involving a specific chemical reaction with the metal even under a low pressure. In addition, adsorption heat thereof always leads to heat radiation.

From the matters described above, it is considered effective to cause chemical adsorption, which generates more energy than the amount of energy generated by the physical adsorption, in order to desorb the gas physically adsorbed to the metal. More specifically, it is considered that, if the chemical adsorption of oxygen is facilitated, physically adsorbed molecules are desorbed and the heat radiation effect can be improved.

Concerning this point, the inventors have found that ionization tendency of metal plays an important role in the chemical adsorption of oxygen to the surface of the metal. That is, usually, oxygen gas or water molecules are adsorbed to a surface of a metal (in the atmosphere, though a thickness of a water layer generated on the surface of the metal differs depending upon a state of humidity, adsorbed water is measured to have a thickness of 10 to 100 Å and, in the wet atmosphere in which fine particles of water deposit, 100 Å to 1 μm). The chemical adsorption of chemically active oxygen gas to the surface of the metal is extremely fast, and an oxidizing velocity thereof becomes higher as the layer of water becomes thicker (the oxidizing velocity may even be lowered when the thickness is 1 μm or more). In addition, if water molecules exist on the surface of the metal, ion exchange action occurs, and the larger the ionization tendency of the metal, the higher an adsorption velocity of oxygen to the metal becomes. Further, since many pollutants such as sulfur dioxide exist in the atmosphere, adsorption of oxygen to the metal is further facilitated.

Here, the ionization tendency of metal means the tendency of a metallic simple substance to become a cation in water, and the metal changes in the water are represented by $M \rightarrow M^{n+} + ne^-$. Oxygen in the air receives electrons and changes to an oxide anion, which is represented as follows:

$$\tfrac{1}{2}O_2(\text{in the air}) + H_2O(\text{water solution}) + 2e^-(\text{metal}) = 2OH^-(\text{water solution})$$

A standard electrode potential in the above-mentioned reaction is calculated as +0.401 from thermodynamic data. Therefore, the smaller a standard electrode potential of the metal, the larger a potential difference between the metal and the oxygen becomes, readily causing an ionization reaction. That is, the larger the ionization tendency of the metal, the easier the ionization reaction with the oxygen occurs.

From the viewpoint of an oxidation-reduction reaction, ionization series is an order of easiness to emit e− of a metallic simple substance, that is, a reduction power. Further, oxygen is a substance with an extremely large oxidation power. In addition, the reaction of metal and oxygen is an exothermic reaction which occurs even if the metal and the oxygen are not under a water environment.

Due to the above-mentioned reasons, it is considered that, by arranging metal with large ionization tendency on a surface of a heat radiating fin, the chemical adsorption of oxygen to the surface of the metal can be facilitated. Thus, molecules physically adsorbed to the surface of the metal can be desorbed to improve the heat radiation effect.

Examples of factors of imparting influence to the heat radiating effect includes a difference between a heat capacity of a heat radiating fin and a heat capacity of the air.

Next, considering a heat flow, heat radiation from an object with high temperature is transmitted to the open air by convection or emission. Then, in a case in which areas are identical, heat transmitted by emission depends upon an emissivity of the object, but heat transmission by convection is largely affected by a state of a fluid which is brought into contact with the object.

Heat transmission in the case in which the temperature of an object is high and heat is radiated to a fluid is represented by the following formula:

$$q = \lambda L(T_1 - T_2)$$

$$= \alpha(T_2 - T_0)$$

where, q is a heat flow (kcal/h·m$^2$), λ is a thermal conductivity of the object (kcal/° C.·h·m), L is a thickness of the object (m), $T_1$ is a temperature of the object (° C.), $T_2$ is a surface temperature of the object on a low temperature side (° C.), $T_0$ is a temperature of the fluid (° C.), and α is a thermal conductivity of the fluid (kcal/° C.·h·m$^2$).

As it is evident from the above formula, when heat transmission of an object placed in a fluid of the same conditions, a larger amount of heat is radiated into the open air as the thermal conductivity of the object is larger and a thickness thereof is smaller.

In addition, heat balance of a system including a heat capacity is represented by the following formula:

$$Q = C \cdot \Delta\theta/\Delta t + W(\theta - \theta_0)$$

where, Q is a supplied amount of heat, θ is an internal temperature, $\theta_0$ is a temperature of open air, t is time, W is a proportionality constant, and C is a heat capacity. The heat capacity is defined as follows:

$$C(\text{heat capacity}) = Q(\text{amount of heat})/\Delta T(\text{temperature difference})$$

That is, ΔT is represented as ΔT=Q/C.

From the above formula, it is seen that, if a supplied amount of heat is constant, heat radiation to the open air increases when a heat capacity is smaller. Therefore, if an object with a small heat capacity is used for a heat radiating plate, inside accumulation of heat decreases, and an amount of heat radiation to the open air can be increased.

In addition, an equilibrium temperature at the time when objects with different heat capacities come into contact with each other is represented by the following formula:

$$T_e(\text{equilibrium temperature}) = (C_1 \cdot T_1 + C_2 \cdot T_2)/(C_1 + C_2)$$

From the above formula, it is seen that the equilibrium temperature is affected by a temperature of an object with a large heat capacity and reaches equilibrium at a temperature close to the temperature of the object with a large heat capacity.

A cause of heat conductance between the air and the heat radiating fin being small compared with that between the water and the heat radiating fin is that a heat capacity of the air is small. The heat capacity is represented by C=V (volume; cm$^3$)×D (density: g/cm$^3$)×c (specific heat; cal/g·° C.). In the same amount of water and air, the water has a larger heat capacity because the specific heat and density of the water is large compared with that of the air, and heat conductance between the water and the heat radiating fin becomes large compared with heat conductance between the air and the heat radiating fin.

That is, by increasing an amount of air brought into contact with the heat radiating fin, the heat capacity of the air can be increased, and the heat conductance between the air and the heat radiating fin can be increased. Increasing the flow rate of air to improve the heat radiation effect thereof means removing air of a high temperature retained in the vicinity of a heat radiating plate and bringing air of a low temperature into contact with the heat radiating plate, thereby removing heat of the heat radiating plate. However, it also means increasing the heat capacity from the air with respect to the heat radiating fin.

From the above description, in other words, reducing the heat capacity of the heat radiating plate means the same as increasing the heat capacity of the air with respect to the heat capacity of the heat radiating plate even if the amount of air brought into contact with the heat radiating fin is the same. Therefore, an amount of heat radiation into the air increases if an object with a small heat capacity is used for the heat radiating fin. Note that, in the case in which air with a small heat capacity is used as a cooling medium, a cooling effect is lowered compared with water with a large heat capacity unless the flow rate of air is increased.

Usually, since a heat resistance at the time when heat is transmitted from a surface of metal into the air is larger than a heat resistance of a metal used as a heat radiating fin, the heat radiation effect cannot be improved unless the heat resistance at the time when heat is transmitted from the surface of the metal to the air is reduced.

From the above description, the inventors considered and found, through experiments, that improvement of the heat radiation effect can be realized by coating the surface of the heat radiating fin with an object with a small heat capacity to make a heat capacity of the object brought into contact with the air small compared with a heat capacity of the air to increase a difference of the heat capacities.

As a result of repeating research based upon the above knowledge, the inventors found that the heat radiation effect can be improved by coating a surface of a metal to be a heat radiating fin with a metal having a large ionization tendency and, further, forming the coating metal layer thin such that a heat capacity thereof is small compared with that of the metal to be the heat radiating fin and bringing the coating layer into contact with the air, thereby completing the present invention.

Therefore, the present invention relates to a heat radiating fin formed of a main body and a coating metal layer stacked (coated) on a surface of the main body, characterized in that at least an ionization tendency of a metallic material constituting the coating metal layer (except for Sn) is larger than that of silver.

Further, the present invention relates to the heat radiating fin, characterized in that the metal material constituting the coating metal layer is selected out of a group including copper, nickel, cobalt, chromium, zinc, manganese, and alloys containing these metals.

Further, the present invention relates to the heat radiating fin, characterized in that the metal material constituting the coating metal layer is selected out of a group including nickel, chromium, zinc, and alloys containing these metals.

Further, the present invention relates to the heat radiating fin according to any one of the above descriptions, characterized in that a heat capacity of the coating metal layer is smaller than a heat capacity of the main body.

Further, the present invention relates to the heat radiating fin according to any one of the above descriptions, characterized in that a layer thickness of the coating metal layer is 0.03 to 10 μm.

Further, the present invention relates to the heat radiating fin according to any one of the above descriptions, characterized in that the main body consists of aluminum.

The present invention relates to a heat radiating method, characterized by radiating heat while bringing the air serving as a cooling fluid into contact with a surface of the heat radiating fin according to any one of the above descriptions.

BRIEF DESCRIPTION OF THE DRAWINGS

FIG. 3 shows sectional views of the heat radiating fins of FIGS. 1 and 2, in which

DETAILED DESCRIPTION OF THE INVENTION

The present invention will be hereinafter described in detail.

Figure 1:
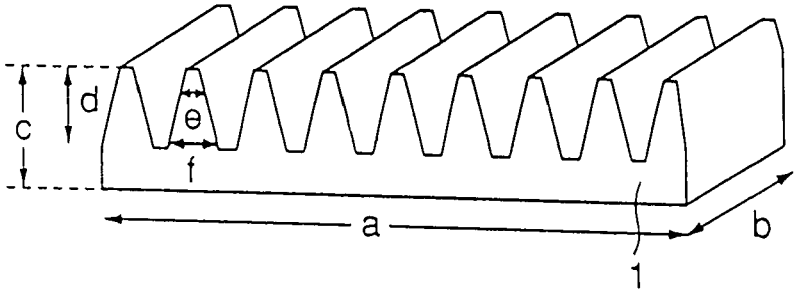
FIG. 1 is a perspective view showing an example of a structure of a heat radiating fin of the present invention.
Figure 2:
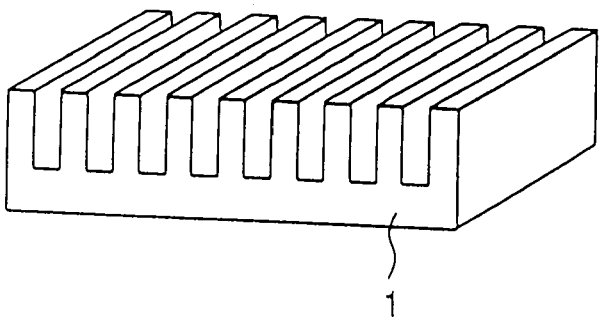
FIG. 2 is a perspective view showing another example of a structure of a heat radiating fin of the present invention.
Figure 3A:
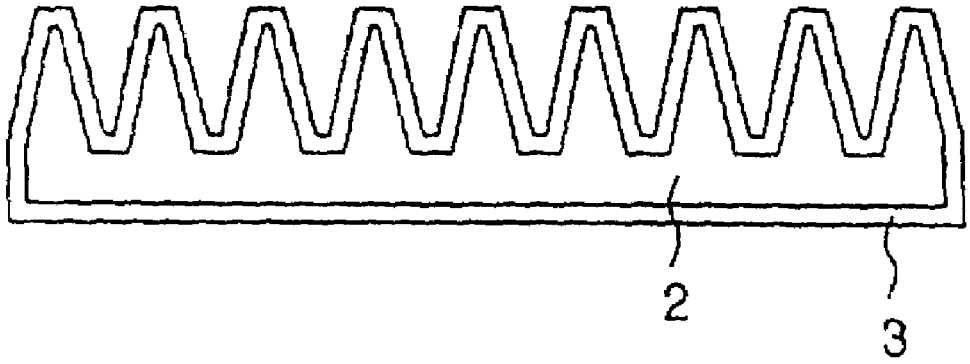
FIG. 3A is a sectional view of the heat radiating fin of FIG. 1.
Figure 3B:
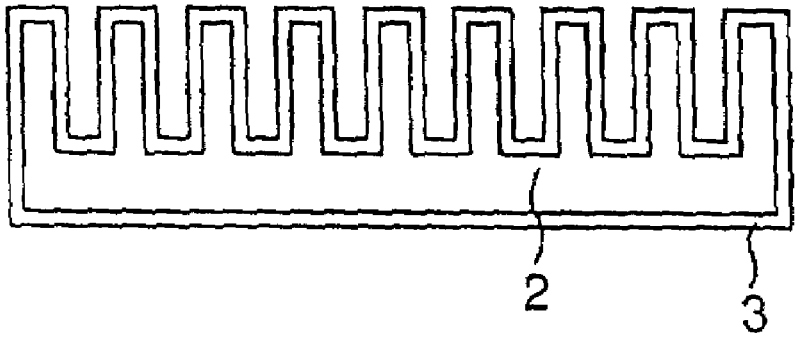
FIG. 3B is a sectional view of the heat radiating fin of FIG. 2.

An embodiment of the present invention will be hereinafter described in accordance with the attached drawings. FIGS. 1 and 2 are perspective views showing examples of a structure of a heat radiating fin of the present invention. FIGS. 3A and 3B are sectional views of the heat radiating fins of FIGS. 1 and 2, in which FIG. 3A is a sectional view of the heat radiating fin of FIG. 1 and FIG. 3B is a sectional view of the heat radiating fin of FIG. 2.

(1) Constituent Material of the Heat Radiating Fin

The heat radiating fin 1 of the present invention is formed of a main body and a coating metal layer 3 stacked (coated) on a surface of the main body.

A material forming the main body can be appropriately selected from metal materials and alloys thereof, which are publicly known conventionally as materials for the heat radiating fin. Examples of such materials include a single metal such as iron, aluminum, copper, nickel, platinum, silver, gold, tungsten, or zinc, and an alloy such as stainless steel, brass, bronze, chromium-nickel alloy, aluminum-silicon alloy, aluminum-manganese alloy, nickel-copper alloy, titanium-iron alloy, titanium-aluminum alloy, or the like. The material may be further provided with a protective film through plating vapor deposition or the like, or may be subjected to surface treatment such as oxidation treatment. Among them, aluminum, copper, or the like are preferably used in terms of cost, light weight property, processability, or the like.

A shape of the main body is not specifically limited, and is selected from various shapes such as a plate shape and a bar shape depending on an application. In addition, a size and a thickness thereof are not specifically limited. For example, in a case in which the main body is manufactured by a metal plate, a thickness of the metal plate can be increased if it is used for a product with large dimensions such as a large apparatus or can be decreased if it is used for a small apparatus. However, the thickness is preferably in a range of 0.01 to 10 mm, and more preferably in a range of 0.1 to 8.0 mm.

Although examples of the shape of such a heat radiating fin main body are shown in FIGS. 1 and 2, the shape is not limited to these. For example, the main body can be formed in an arbitrary shape such as a plate shape, a square shape, a circular shape, a tubular shape, a semispherical shape, or a spherical shape, and a surface thereof may be processed into a corrugated surface, an uneven surface, a projected shape surface, or the like.

(2) Coating Metal Layer

In the present invention, a layer consisting of metal with an ionization tendency larger than that of silver (coating metal layer) is thinly coated on a surface of the above-mentioned heat radiating fin main body, preferably such that a heat capacity thereof is small compared with a heat capacity of the heat radiating fin main body, to coat the heat radiating fin main body.

The ionization tendency referred to here means a result obtained from measurement of a potential difference of two poles, and a measurement value obtained by conducting a measurement with an ordinary oxidation-reduction potentiometer (electronic voltmeter) at room temperature is used as the ionization tendency. In addition, a numerical value calculated from thermodynamics data is used if measurement of a potential difference of two poles is difficult.

As a metallic material which can be used for the coating metal layer in the present invention, it is necessary to select a material with an ionization tendency (which is obtained by the measurement described above) larger than that of silver. Moreover, it is preferable to select a material with a heat capacity smaller than the heat capacity of the heat radiating fin main body.

More specifically, examples of the metal material include copper, nickel, cobalt, chromium, iron, zinc, manganese, aluminum, and magnesium, oxides of these metals, alloys of these metals, and the like. Among these materials, if the ionization tendency is too high, a velocity of oxidation due to the air is increased to change the coating metal into an oxide quickly. As a result, a decrease in the ionization tendency is also quickened to bring about a lowering of the heat radiating effect. Thus, more preferably, a material selected out of a group consisting of copper, nickel, cobalt, chromium, zinc, and manganese, and alloys containing these metals is used. Note that examples of the alloys include nickel-ferrite, nickel-chromium, nickel-copper, nickel-zinc, nickel-copper-zinc, nickel-boron, and the like.

Among them, taking into account a high heat radiating effect, a relatively low velocity of oxidization due to the air, cost, processing property and durability, examples of more preferable materials include zinc, chromium, nickel, or alloys containing these metals. Moreover, examples of most preferable materials among them include nickel, which is the lowest in the ionization tendency, low in an oxidizing velocity, and excellent in durability.

In the present invention, a metallic material constituting the heat radiating fin main body and a metallic material constituting the coating metal layer do not always have to be different materials. However, since the heat radiation effect is further improved if the coating metal layer is formed such that a heat capacity thereof is small compared with a heat capacity of the heat radiating fin main body, taking into account a combination with the metal material of the heat radiating fin main body, a material different from the metal material constituting the heat radiation fin main body can be selected as the metal material constituting the coating metal layer.

The coating metal layer may be coated over the entire surface of the heat radiating fin main body or may be coated only on a part of the main body surface. It is possible to appropriately select a location to be coated and stack the metal layer as required. For example, in the heat radiating fin of the shape shown in FIG. 1 or 2, it is not always necessary to coat the coating metal layer on a bottom surface.

As for a thickness of the coating metal layer (layer thickness), it is desirable to select such a layer thickness with which a difference between heat capacities of the coating metal layer and the air is increased to facilitate the chemical adsorption of molecules in the air. More specifically, it is desirable that the layer thickness is set to a range of 0.03 to 10 μm, preferably 0.037 to 7.5 μm, more preferably 0.1 to 5 μm, and particularly preferably 0.5 to 5 μm. If the layer thickness is too large, heat radiation from the heat radiating fin main body is liable to be impeded. On the other hand, if the layer thickness is too small, since an amount of metal contained in the coating metal layer is little, the coating metal layer, which chemically adsorbs oxygen to improve the heat radiation effect, readily changes to an oxide quickly. Thus, a disadvantage may arise in that the metal contained in the coating metal layer is almost lost and the heat radiation effect is lowered.

Note that the layer thickness referred to here means, for example, assuming that coating metal layers are formed on an upper part, a center part, and a bottom surface of a fin, an average value of layer thicknesses of these three parts obtained by using a thickness meter. The measurement of a layer thickness may be of an arbitrary method and, for example, can be measured by a fluorescent X-ray apparatus or the like.

A stacking method (coating method) for the coating metal layer in the present invention is not specifically limited, and can be selected arbitrarily out of the methods commonly used for forming a thin layer. For example, a liquid phase method such as electric plating, electroless plating, or hot-dip plating from a molten metal, physical vapor deposition (PVD) such as vacuum vapor deposition, ion plating, or sputtering, a vapor phase method such as thermal CVD, plasma CVD, or optical CVD may be used. In addition, the coating metal layer can be stacked by combining these techniques arbitrarily.

In addition, timing for forming the coating metal layer is also arbitrary. For example, the coating metal layer may be formed after processing a metallic material into various shapes to form a heat radiating fin main body, or may be processed into various shapes after being stacked on a metallic material of a plate shape, a bar shape, or the like before processing. Thus, coating can be performed when required.

Further, in FIGS. 1 and 2, the case in which the heat radiating fin main body and the coating metal layer are a single body, respectively, is shown. However, in the present invention, the heat radiating fin main body, or the coating metal layer or both of them can be formed as a complex fin consisting of two or more kinds of materials. For example, the heat radiating fin main body can be formed with a multilayer structure, and the coating metal layer can be formed in a multilayer structure and divided into a surface layer and an inner layer, each of which is manufactured by different materials. In such a case, it is desirable to use the above-mentioned metal material with ionization tendency larger than that of silver for a layer brought into contact with the air layer, and to set a layer thickness thereof to a range of preferably 0.03 to 10 μm, more preferably 0.037 to 7.5 μm, and yet more preferably 0.1 to 5 μm.

(3) Heat Radiating Method

The heat radiating method of the present invention is characterized in that heat is radiated while bringing air serving as a cooling fluid into contact with the surface of the heat radiating fin of the present invention. Since the heat radiating fin of the present invention has a coating metal layer, which is thinly stacked, on the surface thereof such that a heat capacity thereof is smaller than that of the heat radiating fin main body, a heat capacity of the air relatively increases and a difference between the heat capacity of the air and the heat capacity of the heat radiating fin widens. Thus, the heat radiation effect in the case of using the air as a cooling fluid can be improved remarkably.

Note that in this case, the heat radiating method can be used together with a means which has been adopted conventionally in order to facilitate heat radiation. For example, the heat radiating method of the present invention can be used with a method of making a surface uneven, a method of enlarging a heat radiation area such as alumite work or blast work, a method of increasing the number of fins, a method of curving an envelope of a heat radiating fin to increase a velocity and a volume of cooling wind passing through the heat radiating fin, a method of decreasing a heat capacity of a heat radiating fin, and the like. Further, it is possible to enlarge a surface area of the coating metal layer by applying a physical treatment or chemical treatment such as blast work to the coating metal layer and to further improve a heat radiation effect thereof. In addition, it is also possible to further coat a catalyst or the like on the surface of the coating metal layer in order to facilitate chemical adsorption.

DETAILED DESCRIPTION OF VARIOUS EMBODIMENTS OF THE INVENTION

In the figures, reference numeral 1 denotes a heat radiating fin; 2, a heat radiating fin main body; 3, a coating metal layer; 4, a plate of Bakelite; 5, a heater; 6, an aluminum plate for temperature measurement; 7, a hole for temperature measurement; 8, styrene foam plate; 9, a fan; 10, a Peltier element; 11, a cooling surface; and 12, an input terminal, and reference symbol "a" denotes a longitudinal dimension; "b", a latitudinal (width) dimension; "c", a height; "d", a height of the fin; "e", a thickness of an upper part of the fin; and "f", a thickness of a lower part of the fin.

The present invention will hereinafter be described specifically with reference to various embodiments. However, the present invention is not limited only to these embodiments. Note that a layer thickness in these embodiments is an average value obtained by measuring layer thicknesses at three locations, namely, an upper part, a central part, and a bottom surface of a fin, using a fluorescent X-ray apparatus.

First Embodiment

Heat radiating fins of aluminum (hereinafter simply referred to as "fin") having such a shape as shown in FIG. 1 were prepared by planting Zn, Cr, Ni, or Cu on a heat radiating fin main body of aluminum having a length of 100 mm, a width of 100 mm, a height of 40 mm, a fin height of 30 mm, thicknesses of the fin of 2 mm in an upper part and 5 mm in a lower part, and a weight of 480 g (in FIG. 1, a=100 mm, b=100 mm, c=40 mm, d=30 mm, e=2 mm, and f=5 mm. In addition, an identical heat radiating fin with methyl methacrylate-ethyl acrylate-styrene copolymer coated thereon; and an identical heat radiating fin without any processing conducted thereto were also prepared. Note that layer thicknesses of the respective coating layers are as shown in Table 1.

Figure 4:
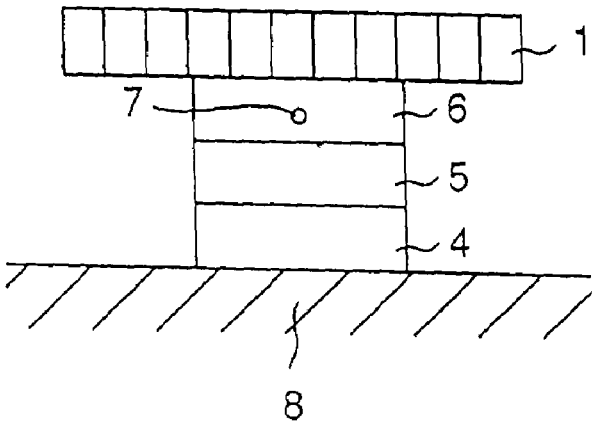
FIG. 4 is a schematic view showing a test apparatus of a first embodiment.

As shown in FIG. 4, a plate of Bakelite 4 a heater 5, an aluminum plate 6 for temperature measurement having a thickness of 10 mm, a length of 50 mm, and a width of 50 mm with a hole 7 for temperature measurement opened on a side thereof, and the fin 1 were laid one on top of another in order, and the fin 1 and the plate of Bakelite 4 were tightened by bolts and closely adhered to each other to manufacture a test apparatus. Then, the test apparatus was placed on a styrene foam plate 8 with the plate of Bakelite 4 on the lower side. Heat radiation grease was applied between the aluminum plate 6 and the fin 1, and between the aluminum plate 6 and the heater 5, respectively.

A heater 5 of 100V/150 W was used, and electric power of 9.5 W (25V/0.38 A) was applied to the heater 5 by a rectifier manufactured by Kikusui Kabushiki Kaisha to cause the heater to radiate heat, and a temperature at the time when heat radiation was started and a temperature after ninety minutes were compared. The results are shown in Table 1. Note that the ionization tendency in this case was large in the order of Zn>Cr>Ni>unprocessed aluminum fin>Cu.

TABLE 1

| Material of coating layer (layer thickness) | Starting temperature (° C.) | Temperature after 90 minutes (° C.) |
|---|---|---|
| Zn (1.455 μm) | 19.8 | 41.8 |
| Cr (1.467 μm) | 19.8 | 42.3 |
| Ni (1.513 μm) | 19.8 | 42.5 |
| Cu (1.499 μm) | 19.8 | 43.5 |
| MM (1.552 μm) | 19.8 | 44.1 |
| No treatment | 19.8 | 44.9 |
| Room temperature | 19.8 | 20.1 |

Note)
MM; methyl methacrylate-ethyl acrylate-styrene copolymer

From the above-mentioned result, it is seen that the temperature after ninety minutes is in the order of Zn<Cr<Ni<Cu<MM<unprocessed aluminum fin, and the temperature falls by 1.4° C. to 3.1° C. by stacking (coating) an object with a small heat capacity compared with the unprocessed aluminum fin, and the heat radiation effect is improved. Then, it is seen that a temperature of a fin coated with Cu, Ni, Cr, or Zn with large ionization tendency compared with chemically inactive methyl methacrylate-ethyl acrylate-styrene copolymer falls by 0.6° C. to 2.3° C., and when the ionization tendency becomes large, the heat radiation effect is improved.

Second Embodiment

As in the first embodiment, identical heat radiating fins of aluminum with Zn, Cr, Ni, or Cu coated by plating on a heat radiating fin main body of aluminum having a length of 100 mm, a width of 100 mm, and a height of 40 mm, a height of a fin of 30 mm, thicknesses of the fin of 2 mm in an upper part and 5 mm in a lower part, and a weight of 480 g; with methyl methacrylate-ethyl acrylate-styrene copolymer coated thereon; and without any processing conducted thereto were prepared. Note that layer thicknesses of the respective coating layers are as shown in Table 2.

Figure 5:
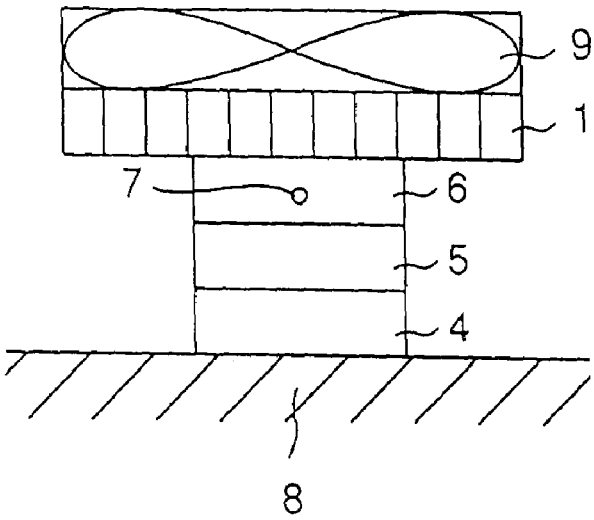
FIG. 5 is a schematic view showing a test apparatus of a second to a sixth embodiment.

As shown in FIG. 5, the plate of Bakelite 4, the heater 5, the aluminum plate 6 for temperature measurement having a thickness of 10 mm, a length of 50 mm, and a width of 50 mm with the hole 7 for temperature measurement opened on a side thereof, and the fin 1 were laid one on top of another in order, and the fin 1 and the plate of Bakelite 4 were tightened by bolts and closely adhered to each other to manufacture a test apparatus. Then, the test apparatus was placed on the styrene foam plate 8 with the plate of Bakelite 4 on the lower side. Then, the cooling fan 9 (having a length of 80 mm, a width of 80 mm; manufactured by Sanyo Denki Co., Ltd.; number of revolutions 2, 900 rpm, 12V/0.13 A; flow rate of air=1.03 $m^3$/m) was directly attached to the upper part of the fin on the upper side to perform cooling. Heat radiation grease was applied between the aluminum plate 6 and the fin 1 and between the aluminum plate 6 and the heater 5, respectively.

A heater of 100V/150 W was used as the heater 5, and electric power of 84.75 W (75V/1.13 A) was applied to the heater 5 by a rectifier manufactured by Kikusui Kabushiki Kaisha to cause the heater to radiate heat, and a temperature at the time when heat radiation was started and a temperature after ninety minutes were compared. The results are shown in Table 2. Note that the ionization tendency in this case was large in the order of Zn>Cr>Ni>unprocessed aluminum fin>Cu.

TABLE 2

| Material of coating layer (layer thickness) | Starting temperature (° C.) | Temperature after 90 minutes (° C.) |
|---|---|---|
| Zn (1.455 μm) | 18.1 | 53.8 |
| Cr (1.467 μm) | 18.1 | 54.3 |
| Ni (1.513 μm) | 18.1 | 54.4 |
| Cu (1.499 μm) | 18.1 | 54.7 |
| MM (1.552 μm) | 18.1 | 56.9 |
| No treatment | 18.1 | 57.5 |
| Room temperature | 18.1 | 18.4 |

Note)
MM; methyl methacrylate-ethyl acrylate-styrene copolymer

From the above-mentioned results, it is seen that the temperature after ninety minutes is also in the order of Zn<Cr<Ni<Cu<MM<unprocessed aluminum fin even if cooling by a fan, and the temperature falls by 0.6° C. to 3.7° C. by stacking (coating) an object with a small heat capacity compared with the unprocessed aluminum fin, and the heat radiation effect is improved. Further, it is seen that a temperature of a fin coated with Cu, Ni, Cr, or Zn with a large ionization tendency compared with chemically inactive methyl methacrylate-ethyl acrylate-styrene copolymer falls by 2.2° C. to 3.1° C., and the heat radiation effect of the heat radiating fin coated with the layer having a large ionization tendency is improved by ventilation using a fan.

Third Embodiment

Identical heat radiating fins of aluminum, similar to those used in the second embodiment, with Zn, Cr, Ni, Cu, or MM coated on a heat radiating fin main body of aluminum; and without any processing conducted thereto were prepared. Note that layer thicknesses of the respective coated layers are as shown in Table 3.

The plate of Bakelite 4, the heater 5, the aluminum plate 6 for temperature measurement, and the fin 1 were laid one on top of another in order to manufacture a test apparatus that is similar to the one manufactured in the second embodiment. Then, the fin 1 and the plate of Bakelite 4 were tightened by bolts and closely adhered to each other, and the test apparatus was placed on the styrene foam plate 8 with the plate of Bakelite 4 on the lower side. Further, the cooling fan 9 that is similar to the one used in the second embodiment (a length of 80 mm, a width of 80 mm; manufactured by Sanyo Denki Co., Ltd.) was attached to the upper part of the fin.

A heater 5 of 100V/150 W was used, and without changing the applied electric power of 84.75 W (75V/1.13 A), a temperature of the central part of aluminum at the time when heat radiation was started and after ninety minutes were compared under the respective conditions that the number of revolutions of the fan 9 was changed to 1800 rpm (flow rate: 0.92 $m^3$/m), 2900 rpm (flow rate: 1.03 $m^3$/m), and 3400 rpm (flow rate: 1.20 $m^3$/m). The results are shown in Table 3. Note that ionization tendency in this case was large in the order of Zn>Cr>Ni>unprocessed aluminum fin>Cu.

TABLE 3

| Type/Number of revolutions | 1800 rpm | | 2900 rpm | | 3400 rpm | |
|---|---|---|---|---|---|---|
| Material of coating layer (layer thickness · μm) | Starting temperature (° C.) | Temperature after 90 minutes (° C.) | Starting temperature (° C.) | Temperature after 90 minutes (° C.) | Starting temperature (° C.) | Temperature after 90 minutes (° C.) |
| Zn (1.455) | 17.3 | 67.6 | 16.9 | 53.8 | 17.4 | 50.1 |
| Cr (1.467) | 17.3 | 67.9 | 16.9 | 54.3 | 17.4 | 50.7 |
| Ni (1.513) | 17.3 | 68 | 16.9 | 54.4 | 17.4 | 50.9 |
| Cu (1.499) | 17.3 | 68.3 | 16.9 | 54.7 | 17.4 | 51.3 |
| MM (1.552) | 17.3 | 70 | 16.9 | 56.9 | 17.4 | 54.1 |
| No treatment | 17.3 | 70.2 | 16.9 | 57.5 | 17.4 | 54.2 |

Note)
MM; methyl methacrylate-ethyl acrylate-styrene copolymer

From the above-mentioned results, it is seen that the temperature after ninety minutes is also in the order of Zn<Cr<Ni<Cu<MM<unprocessed aluminum fin, even if changing the number of revolutions of the fan, and the temperature falls by 0.2° C. to 2.6° C. in the case of 1800 rpm, by 0.6° C. to 3.7° C. in the case of 2900 rpm, and 0.1° C. to 4.1° C. in the case of 3400 rpm, by stacking (coating) a layer with a small heat capacity compared with the unprocessed aluminum fin, and the heat radiation effect is improved. Further, it is seen that a temperature of a fin coated with Cu, Ni, Cr, or Zn with a large ionization tendency compared with chemically inactive methyl methacrylate-ethyl acrylate-styrene copolymer falls by 1.7° C. to 2.4° C. in the case of 1800 rpm, 2.2° C. to 3.1° C. in the case of 2900 rpm, and 2.8° C. to 4.0° C. in the case of 3400 rpm, and the heat radiation effect of the heat radiating fin coated with the object with the large ionization tendency is improved by increasing the number of revolutions of the fan.

Fourth Embodiment

Identical heat radiating fins of aluminum, similar to those used in the third embodiment, with Zn, Cr, Ni, Cu, or MM coated on a heat radiating fin main body of aluminum; and without any processing conducted thereto were prepared. Note that layer thicknesses of the respective coating layers are as shown in Table 4.

The plate of Bakelite 4, the heater 5, the aluminum plate 6 for temperature measurement, and the fin 1 were laid one on top of another in order to manufacture a test apparatus that is similar to the one manufactured in the third embodiment. Then, the fin 1 and the plate of Bakelite 4 were tightened by bolts and closely adhered to each other, and the test apparatus was placed on the styrene foam plate 8 with the plate of Bakelite 4 on the lower side. Further, the cooling fan 9 that is similar to the one used in the third embodiment (a length of 80 mm, a width of 80 mm; manufactured by Sanyo Denki Co., Ltd.) was attached to the upper part of the fin.

A heater of 100V/150 W was used, and while keeping the number of revolutions of the fan 9 to 2900 rpm (flow rate: 1.03 $m^3$/m), a temperature at the time when heat radiation was started and a temperature after ninety minutes were compared under the respective conditions that the electric power applied was changed to 37.5 W, 84.7 W, and 150 W. The results are shown in Table 4. Note that ionization tendency in this case was large in the order of Zn>Cr>Ni>unprocessed aluminum fin>Cu.

From the above-mentioned results, it is seen that the temperature after ninety minutes is also in the order of Zn<Cr<Ni<Cu<MM<unprocessed aluminum fin even after changing the electric power to be applied, and the temperature falls by 0.3° C. to 1.2° C. in the case of 37.5 W, by 0.6° C. to 3.7° C. in the case of 84.75 W, and 0.5° C. to 4.2° C. in the case of 150 W, and the heat radiation effect is improved by coating a layer with a small heat capacity compared with the unprocessed aluminum fin. Then, it is seen that a temperature of a fin coated with Cu, Ni, Cr, or Zn with a large ionization tendency compared with chemically inactive methyl methacrylate-ethyl acrylate-styrene copolymer falls by 1.6° C. to 1.9° C. in the case of 37.5 W, 2.2° C. to 3.1° C. in the case of 84.75 W, and 2.8° C. to 3.7° C. in the case of 150 W, and the heat radiation effect of the heat radiating fin coated with the object with large ionization tendency is improved by increasing the electric power to be applied.

Fifth Embodiment

The same aluminum fins as the first embodiment with Zn coated thereon with a thickness of 0.037 μm, 0.106 μm, 0.503 μm, 1.455 μm, 2.883 μm, 3.787 μm, 4.993 μm, 6.112 μm, 7.568 μm, and 10.231 μm, respectively, were used to compare respective temperatures thereof after ninety minutes with the same method as the second embodiment. The results are shown in Table 5.

TABLE 5

| Layer thickness of zinc | Starting temperature (° C.) | Temperature after 90 minutes (° C.) |
|---|---|---|
| 0.037 μm | 19.5 | 57.3 |
| 0.106 μm | 19.5 | 56.3 |
| 0.503 μm | 19.5 | 53.8 |
| 1.455 μm | 19.5 | 53.1 |
| 2.883 μm | 19.5 | 54.3 |
| 3.787 μm | 19.5 | 54.8 |
| 4.993 μm | 19.5 | 55.3 |
| 6.112 μm | 19.5 | 56.9 |
| 7.568 μm | 19.5 | 57.4 |
| 10.231 μm | 19.5 | 57.8 |
| No treatment | 19.5 | 58.1 |
| Room temperature | 19.5 | 19.9 |

From the above-mentioned result, it is seen that improvement in the heat radiation effect is remarkable when the thickness of zinc is in a range of 0.037 μm to 10 μm, more remarkable when the thickness is in a range of 0.1 μm to 7.5 μm, and in particular when the thickness is in a range of 0.5 μm to 5 μm.

TABLE 4

| Type/Applied electric power | 37.5 W | | 84.75 W | | 150 W | |
|---|---|---|---|---|---|---|
| Material of coating layer (layer thickness · μm) | Starting temperature (° C.) | Temperature after 90 minutes (° C.) | Starting temperature (° C.) | Temperature after 90 minutes (° C.) | Starting temperature (° C.) | Temperature after 90 minutes (° C.) |
| Zn (1.455) | 17.5 | 33.2 | 16.9 | 53.8 | 17.1 | 86.2 |
| Cr (1.467) | 17.5 | 33.3 | 16.9 | 54.3 | 17.1 | 86.7 |
| Ni (1.513) | 17.5 | 33.4 | 16.9 | 54.4 | 17.1 | 86.7 |
| Cu (1.499) | 17.5 | 33.5 | 16.9 | 54.7 | 17.1 | 87.1 |
| MM (1.552) | 17.5 | 35.1 | 16.9 | 56.9 | 17.1 | 89.9 |
| No treatment | 17.5 | 35.4 | 16.9 | 57.5 | 17.1 | 90.4 |

Note)
MM; methyl methacrylate-ethyl acrylate-styrene copolymer

Sixth Embodiment

The same aluminum fins as the first embodiment with Ni coated thereon with a thickness of 0.031 μm, 0.587 μm, 0.998 μm, 1.486 μm, 2.999 μm, 3.893 μm, 4.875 μm, 5.669 μm, 7.665 μm, and 10.026 μm, respectively, were used to compare respective temperatures thereof after ninety minutes with the same method as the second embodiment. The results are shown in Table 6.

TABLE 6

| | Starting temperature (° C.) | Temperature after 90 minutes (° C.) |
|---|---|---|
| 0.031 μm | 19.8 | 57.1 |
| 0.587 μm | 19.8 | 56.6 |
| 0.998 μm | 19.8 | 54.8 |
| 1.486 μm | 19.8 | 53.5 |
| 2.999 μm | 19.8 | 54.1 |
| 3.893 μm | 19.8 | 54.9 |
| 4.875 μm | 19.8 | 56.2 |
| 5.669 μm | 19.8 | 56.8 |
| 7.665 μm | 19.8 | 57.3 |
| 10.026 μm | 19.8 | 58.1 |
| No treatment | 19.8 | 58.2 |
| Room temperature | 19.8 | 20.1 |

From the above-mentioned results, it is seen that improvement in the heat radiation effect is remarkable when the thickness of nickel is in a range of 0.03 μm to 10 μm, more remarkable when the thickness is in a range of 0.5 μm to 7.5 μm, and in particular when the thickness is in a range of 0.5 μm to 6 μm.

Seventh Embodiment

A heat radiating fin have the shape shown in FIG. 2 with Zn coated thereon with a thickness of 0.034 μm, 0.098 μm, 0.532 μm, 1.612 μm, 3.661 μm, 5.053 μm, 6.022 μm, 7.889 μm, and 10.088 μm, respectively, on a heat radiating fin main body of aluminum with a length of 100 mm, a width of 100 mm, and a height of 40 mm, the number of fins of 625, a fin height of 34 mm, and a fin thickness of 2 mm×2 mm was used.

Figure 6:
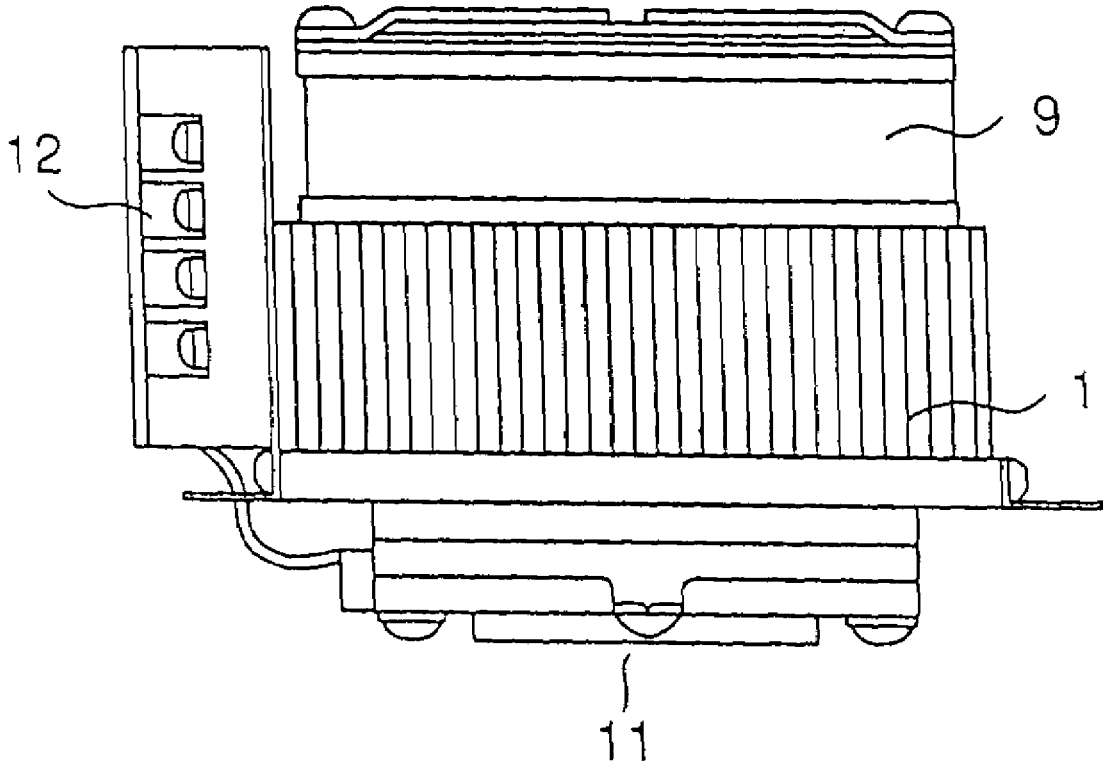
FIG. 6 is a side view showing a cooling device used in a test apparatus of a seventh and eighth embodiment.

A cooling device (manufactured by Frigester Kabushiki Kaisha; F44-HS), in which the heat radiating fin 1 with the Peltier element 10 is subjected to the above-mentioned treatment is arranged and the cooling fan 9 (having a length of 100 mm, a width of 100 mm; the number of revolutions of 3600 rpm; 12V/0.175 A) is arranged thereon in order, as shown in FIG. 6 was used.

Figure 7:
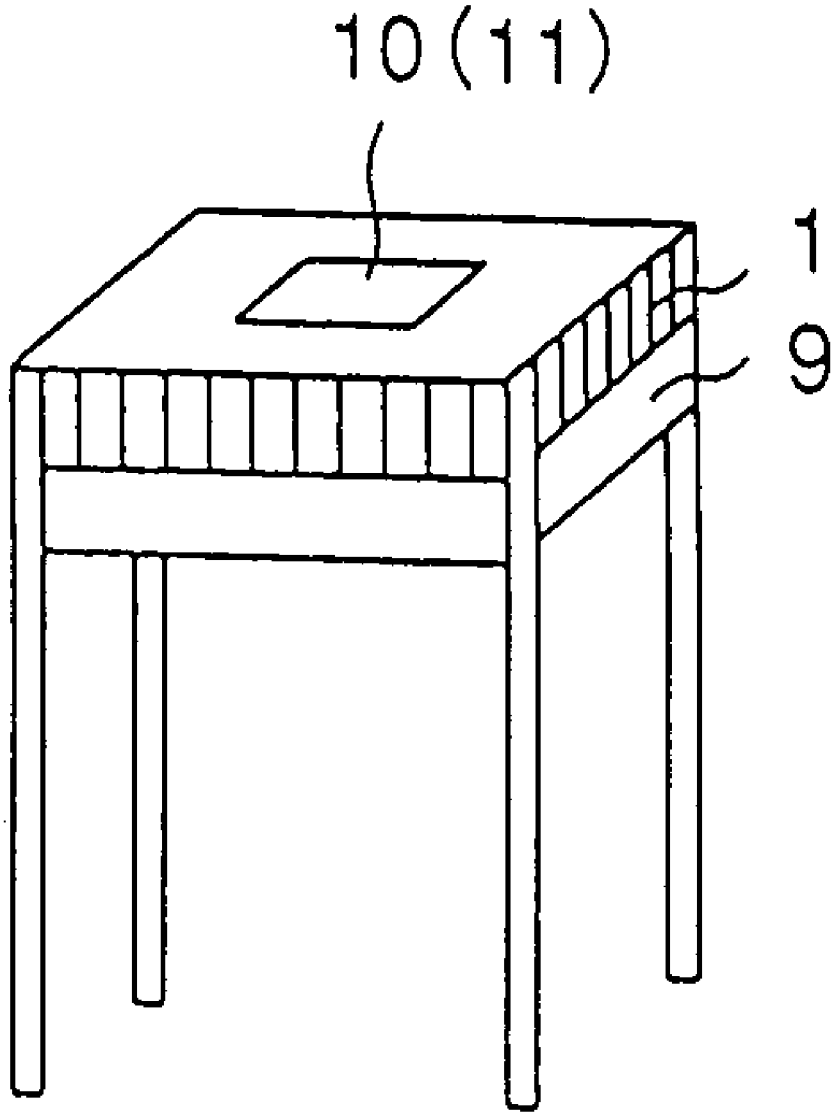
FIG. 7 is a schematic view showing the test apparatus of the seventh and eighth embodiments.

The heat radiating fin and the Peltier element were closely adhered by heat radiating grease. Then, as shown in FIG. 7, the cooling device was arranged such that the cooling surface 11 (Peltier element portion; temperature measurement point) was on the upper side and the heat radiating fin was on the lower side to rotate the fan, a voltage of 12 V was applied to the Peltier element 10, and the temperatures on the cooling surface after ninety minutes were compared. The results are shown in Table 7.

TABLE 7

| | Starting temperature (° C.) | Temperature after 90 minutes (° C.) |
|---|---|---|
| 0.034 μm | 22.8 | −14.3 |
| 0.098 μm | 22.8 | −16.8 |
| 0.532 μm | 22.8 | −17.5 |

TABLE 7-continued

| | Starting temperature (° C.) | Temperature after 90 minutes (° C.) |
|---|---|---|
| 1.612 μm | 22.8 | −18.2 |
| 3.661 μm | 22.8 | −16.9 |
| 5.053 μm | 22.8 | −16.0 |
| 6.022 μm | 22.8 | −15.2 |
| 7.889 μm | 22.8 | −14.7 |
| 9.975 μm | 22.8 | −14.4 |
| No treatment | 22.8 | −14.1 |
| Room temperature | 22.8 | 22.4 |

From the above-mentioned results, it is seen that a reduction in the temperatures on the cooling surface is significant and improvement in the heat radiation effect is remarkable when the thickness of zinc is in a range of 0.03 μm to 10 μm, more remarkable when the thickness is in a range of 0.03 μm to 8 μm, and in particular when the thickness is in a range of 0.1 μm to 5 μm.

Eighth Embodiment

A test apparatus using the Peltier element was manufactured in the same manner as in the seventh embodiment, except that heat radiating fins of aluminum (one provided with a coating metal layer and one without being subjected to processing) which are the same as those used in the first embodiment were used. Temperatures in the center of an aluminum plate set on a cooling side at the time when voltages of 7.5 V and 10 V were applied and the number of revolution of a fan was changed as 1800 rpm, 2900 rpm, and 3400 rpm were compared. The results are shown in Table 8.

TABLE 8

| Number of revolutions | 1800 rpm | | 2900 rpm | | 3400 rpm | |
|---|---|---|---|---|---|---|
| Type/Voltage | 7.5 V | 10 V | 7.5 V | 10 V | 7.5 V | 10 V |
| Zn (1.455 μm) | 1.4 | 0.5 | 0.5 | −0.5 | 0.1 | −1.1 |
| Cr (1.467 μm) | 2.1 | 1.3 | 1.5 | 0.6 | 0.6 | −0.3 |
| Ni (1.513 μm) | 2.2 | 1.5 | 1.7 | 0.8 | 0.7 | −0.1 |
| Cu (1.499 μm) | 2.5 | 1.7 | 1.9 | 0.9 | 1.3 | 0.6 |
| MM (1.552 μm) | 4.1 | 3.2 | 3.3 | 2.8 | 2.7 | 2.3 |
| No treatment | 5.8 | 5.4 | 3.5 | 3.1 | 3.6 | 6.0 |
| Room temperature | 20.1 | 20.0 | 20.2 | 20.3 | 20.0 | 20.2 |

Note)
MM; methyl methacrylate-ethyl acrylate-styrene copolymer

From the above result, it is seen that, even if an applied voltage and the number of revolutions of the cooling fan are changed, the heat radiation effect is improved and a temperature on the cooling surface is decreased by coating the surface with a layer having a large ionization tendency.

INDUSTRIAL APPLICABILITY

Since the heat radiating fin of the present invention is provided with a coating metal layer consisting of a metallic material with a large ionization tendency, the chemical adsorption of oxygen in the air to a surface of the heat radiating fin is facilitated, and molecules physically adsorbed to the surface are desorbed to remarkably improve the heat radiation effect. In addition, since the heat radiating fin has the coating metal layer thinly coated such that a heat capacity thereof is smaller than that of the heat radiating fin main body, a heat capacity of the air increases relatively, a difference between the heat capacity of the air and a heat capacity of the heat radiating fin widens, and the heat radiation effect in the case in which the air is used as a cooling fluid is further improved.

According to the heat radiating method using the heat radiating fin of the present invention, since the air is used as a cooling fluid, a high heat radiating effect can be obtained without installing a circulation system with an apparatus such as a pump as in a water cooling system using a cooling liquid such as water, and a compact, light-weight and inexpensive cooling device can be provided. In addition, since the heat radiation efficiency is better than the conventional air cooling system, problems such as an increase in the size of an apparatus and noise following ventilation can be eliminated.

The heat radiating fin of the present invention can be utilized effectively not only in a display apparatus such as a television, a computer, or a plasma display, an electric product/an electronic apparatus such as a refrigerator or a motor, and various mechanical apparatuses such as an engine or radiator of an automobile, a heat exchanger, a nuclear reactor, and a generator, but also in switches, a heating element of a small integrated circuit such as an IC chip or an electronics device, and the like.

The invention claimed is:

1. A heat radiating fin comprising:

a main body; and a coating metal layer coating a surface of said main body, said coating metal layer comprising a metallic material silver selected from a group consisting of nickel, chromium, zinc, and alloys containing at least one of nickel, chromium, and zinc, a thickness of said coating metal layer being no greater than 5 μm, and a heat capacity of said coating metal layer being smaller than a heat capacity of said main body.

2. The heat radiating fin of claim 1, wherein said coating metal layer is an outer coating metal layer such that the outer surface of said outer coating metal layer is the outer surface of said heat radiating fin.

3. The heat radiating fin of claim 2, wherein said main body consists of aluminum.

4. The heat radiating fin of claim 2, wherein said outer coating metal layer coats an entirety of said surface of said main body.

5. The heat radiating fin of claim 4, wherein said metallic material of said coating metal layer comprises only a single type of metallic material.

6. The heat radiating fin of claim 1, wherein said main body consists of aluminum.

7. The heat radiating fin of claim 1, wherein said coating metal layer coats an entirety of said surface of said main body.

8. The heat radiating fin of claim 1, wherein a thickness of said coating metal layer is no less than 0.1 μm.

9. A method of radiating heat, comprising:

bringing cooling air into contact with a surface of a heat radiating fin, the heat radiating fin including:

a main body; and a coating metal layer coating a surface of the main body, the coating metal layer comprising a metallic material selected from a group consisting of nickel, chromium, zinc, and alloys containing at least one of nickel, chromium, and zinc, a thickness of the coating metal layer being no greater than 5 μm, and a heat capacity of said coating metal layer being smaller than a heat capacity of said main body.

10. The heat radiating method of claim 9, wherein the coating metal layer is an outer coating metal layer such that said bringing the cooling air into contact with the surface of the heat radiating fin comprises bringing the cooling air into contact with the outer surface of the outer coating metal layer.

11. The heat radiating method of claim 10, wherein the main body consists of aluminum.

12. The heat radiating method of claim 10, wherein the outer coating metal layer coats an entirety of the surface of the main body so that the cooling air does not contact the surface of the main body.

13. The heat radiating method of claim 9, wherein the main body consists of aluminum.

14. The heat radiating method of claim 9, wherein the coating metal layer coats an entirety of the surface of the main body.

15. The heat radiating method of claim 9, wherein a thickness of the coating metal layer is no less than 0.1 μm.

* * * * *